US008951057B2

(12) United States Patent
Linder et al.

(10) Patent No.: US 8,951,057 B2
(45) Date of Patent: Feb. 10, 2015

(54) PLUG-TYPE CONNECTION FOR TRANSMITTING ELECTRICAL ENERGY

(75) Inventors: Andreas Linder, Roschenz (CH); Patrick Beltzer, Jettingen (FR)

(73) Assignee: Multi-Holdings AG, Allschwil (CH)

( * ) Notice: Subject to any disclaimer, the term of this patent is extended or adjusted under 35 U.S.C. 154(b) by 89 days.

(21) Appl. No.: 13/642,247

(22) PCT Filed: Jun. 1, 2011

(86) PCT No.: PCT/EP2011/059082

§ 371 (c)(1),
(2), (4) Date: Oct. 19, 2012

(87) PCT Pub. No.: WO2011/154303

PCT Pub. Date: Dec. 15, 2011

(65) Prior Publication Data

US 2013/0034982 A1 Feb. 7, 2013

(30) Foreign Application Priority Data

Jun. 11, 2010 (CH) ..... 946/10

(51) Int. Cl.
*H01R 13/62* (2006.01)
*H01R 13/639* (2006.01)
*H01R 13/187* (2006.01)

(52) U.S. Cl.
CPC ..... *H01R 13/639* (2013.01); *H01R 13/187* (2013.01)
USPC ..... 439/314; 439/318; 439/332

(58) Field of Classification Search
USPC ..... 439/314, 316–319, 332–333, 335, 439/337–338
See application file for complete search history.

(56) References Cited

U.S. PATENT DOCUMENTS 4,902,094 A * 2/1990 Shank ..... 385/55
5,015,195 A 5/1991 Piriz
5,685,730 A 11/1997 Cameron et al.
6,226,068 B1 * 5/2001 Arcykiewicz et al. ..... 439/314
6,921,283 B2 * 7/2005 Zahlit et al. ..... 439/489

FOREIGN PATENT DOCUMENTS

AT 410 617 B 6/2003
DE 10 2007 027 760 A1 12/2008

* cited by examiner

*Primary Examiner* — Xuong Chung Trans
(74) *Attorney, Agent, or Firm* — Sughrue Mion, PLLC

(57) ABSTRACT

A plug-type connection comprises a housing (1) on the female-connector side having a female-connector element (3) conducting the electrical current, a housing (2) on the male-connector side having a male-connector element (4) conducting the electrical current, and at least one contact element (5) for making electrical contact between the female-connector element (3) and the male-connector element (4). The female-connector element (3) and the male-connector element (4) extend substantially along a mid-axis (M). The housing (1) on the female-connector side and the housing (2) on the male-connector side and therefore the female-connector element (3) and the male-connector element (4) can be connected to one another via a plug-in movement (S), and electrical contact between the female-connector element (3) and the male-connector element (4) is produced in the connected state. The contact element (5) produces a first resistive force (F1) counter to the plug-in movement. The plug-type connection furthermore comprises an automatically self-locking locking element (6) for locking the plug-type connection, said locking element (6) producing a second resistive force (F2) counter to the plug-in movement (S). Guide elements (7) are provided between the housing (1) on the female-connector side and the housing (2) on the male-connector side, said guide elements being designed such that the application of a torque to at least one of the two housings (1, 2) results in an assisting force in the direction of the plug-in movement (S), with the result that at least part of the resistive forces (F1, F2) can be overcome by this resistive force.

12 Claims, 9 Drawing Sheets

PLUG-TYPE CONNECTION FOR TRANSMITTING ELECTRICAL ENERGY

TECHNICAL FIELD

The present invention relates to a plug-type connection for transmitting electrical energy having a female connector side and a male connector side according to the preamble of claim 1.

STATE OF THE ART

A plurality of plug-type connections for connecting cables is known from the state of the art in the field of energy technology. Plug-type connections of this kind are used, for example, to make a connection between an emergency power generator and the energy company's point of entry in a building in the event of a power failure.

Currents in the region of a few hundred amperes are typically transmitted across energy cables of this kind. The electrical conductor typically has a cross-section in the range of 40 $mm^2$ to 600 $m^2$ for this purpose. Cross-sections of this kind tend to be unwieldy for the user having to make the plug-type connection on account of their size.

The plug-type connections known from the state of the art each have a male-connector part or a plug-connector part and a female-connector part, these being connectable to one another. A contact element, such as a contact fin, for example, is provided between the electrical conductor of the female-connector part and that of the plug-connector part. In addition, a sealing element is typically disposed between the female-connector part and the plug-connector part, which prevents moisture, dust or even water from being able to get into the contact element area.

When making the plug-type connection between the female-connector part and the plug-connector part, the user must apply a comparatively large amount of force, in order to push the plug-connector part into the female-connector part, whereupon corresponding axial resistive forces have to be overcome. The maximum resistive force is typically made up of various resistive forces. The first resistive force that should be mentioned is the force that must be applied, in order to overcome the contact element resistance between the plug-connector part and the female-connector part. A further resistive force must be applied in order to overcome the resistance of any sealing element. Consequently, the user must apply an axial force, in order to overcome the aforementioned resistive forces.

In summary, it is very detrimental for the user wishing to make a plug-type connection to have to apply a comparatively large force in the direction of the mid-axis, in order to make a connection between the plug and socket. Particularly in an emergency, such as connecting an emergency power system at a hospital, the connection of the male-connector side and the female-connector side delays the starting of the emergency power system and can be highly detrimental as a result, even leading to personal injury in the worst case.

DESCRIPTION OF THE INVENTION

Based on this state of the art, the problem addressed by the invention is that of specifying a plug-type connection which removes the disadvantages of the state of the art. In particular, a plug-type connection for an electrical connection is to be specified which reduces the force that has to be applied to produce the plug-type connection in an axial direction, so that it is easier for the user to connect the female-connector part to the plug-connector part.

A problem of this kind is solved by a plug-type connector housing according to claim 1. According to this, a plug-type connection comprises a housing on the female-connector side having at least one female-connector element conducting the electrical current, a housing on the male-connector side having a male-connector element conducting the electrical current and at least one contact element for making an electrical contact between the female-connector element and the male-connector element. The female-connector element and the male-connector element extend substantially along a mid-axis. The housing on the female-connector side and the housing on the male-connector side and therefore the female-connector element and the male-connector element are connectable to one another via a plug-in movement and electrical contact between the female-connector element and the male-connector element is produced in the connected state. The contact element produces a first resistive force counter to the plug-in movement, which must be overcome in order to make the plug-type connection. The plug-type connection further comprises an automatically self-locking locking element for locking the plug-type connection, which locking element produces a second resistive force counter to the plug-in movement. Guide elements are provided between the housing on the female-connector side and the housing on the male-connector side, said guide elements being designed such that the application of a torque to at least one of the two housings results in an assisting force in the direction of the plug-in movement, with the result that at least part of the resistive forces can be overcome by this assisting force.

Because the user is able to apply a torque, it is more ergonomic for them to make the plug-type connection.

A one-pin connection with a single female-connector element and a single male-connector element is particularly preferably used. However, a multi-pin connection is also conceivable, wherein a plurality of female-connector elements and a plurality of male-connector elements then have to be provided.

Furthermore, a sealing element is preferably disposed between the housing on the female-connector side and the housing on the male-connector side, which seals the gap between the housing on the female-connector side and the housing on the male-connector side against fluids, such as water, or air, wherein the sealing element produces a third resistive force counter to the plug-in movement.

Depending on the design, the resistive forces usually act in an axial direction, in the mid-axis direction, in other words.

The guide elements are preferably designed such that the plug-in movement runs over a first section along a translational motion parallel to the mid-axis and over a second section with a rotational motion or a combination of rotational and translational motion.

The guide elements preferably consist of the guide duct and guide comb pair, which projects into the guide comb. The guide duct is disposed on a housing in this case, so for example on the housing on the female-connector side or on the male-connector side, and the guide comb is disposed on the other housing, in other words on the housing on the male-connector side or on the female-connector side.

The locking element preferably has a limit stop, which the one housing strikes during the plug-in movement, wherein the locking element is displaced in a translatory manner with the one housing via this limit stop and wherein the second resistive force opposes the plug-in movement when the locking element is displaced via the housing.

The guide element is preferably designed such that it secures the two housings against axial displacement in the connected state, while the locking element prevents the two housings from rotating relative to one another.

When the connected state is reached, the locking element is preferably automatically moved against the plug-in direction from the housing against which the locking element lies to the other housing. In this case, the locking element provides a lock preventing rotation of the housings relative to one another, wherein the lock is supplied particularly by the limit stop, which projects into a catching recess.

The locking element is preferably disposed such that the assisting force takes effect when the second resistive force also has to be overcome and/or that the sealing element is disposed such that the assisting force takes effect when the third resistive force also has to be overcome. When these two or one of the two forces takes effect, the total resistive force is even higher compared with the first resistive force. To this extent, it is particularly advantageous that compensation can be introduced via the torque when the resistive force is highest.

The guide elements preferably comprise a guide duct and at least one guide comb projecting into the guide duct, wherein the guide duct runs via a first section parallel to the plug-type connection and via a second section at an angle to the plug-in movement.

The locking element is preferably connected either to the housing on the female-connector side or to the housing on the male-connector side in a manner axially displaceable to the respective element, wherein a spring generates the second resistive force.

Further advantageous embodiments are characterized in the dependent claims.

BRIEF DESCRIPTION OF THE DRAWINGS

Preferred embodiments of the invention are described in the following with the help of the drawings, which only serve as an explanation and should not be interpreted as limiting. In the drawings.

DESCRIPTION OF PREFERRED EMBODIMENTS

Figure 1:
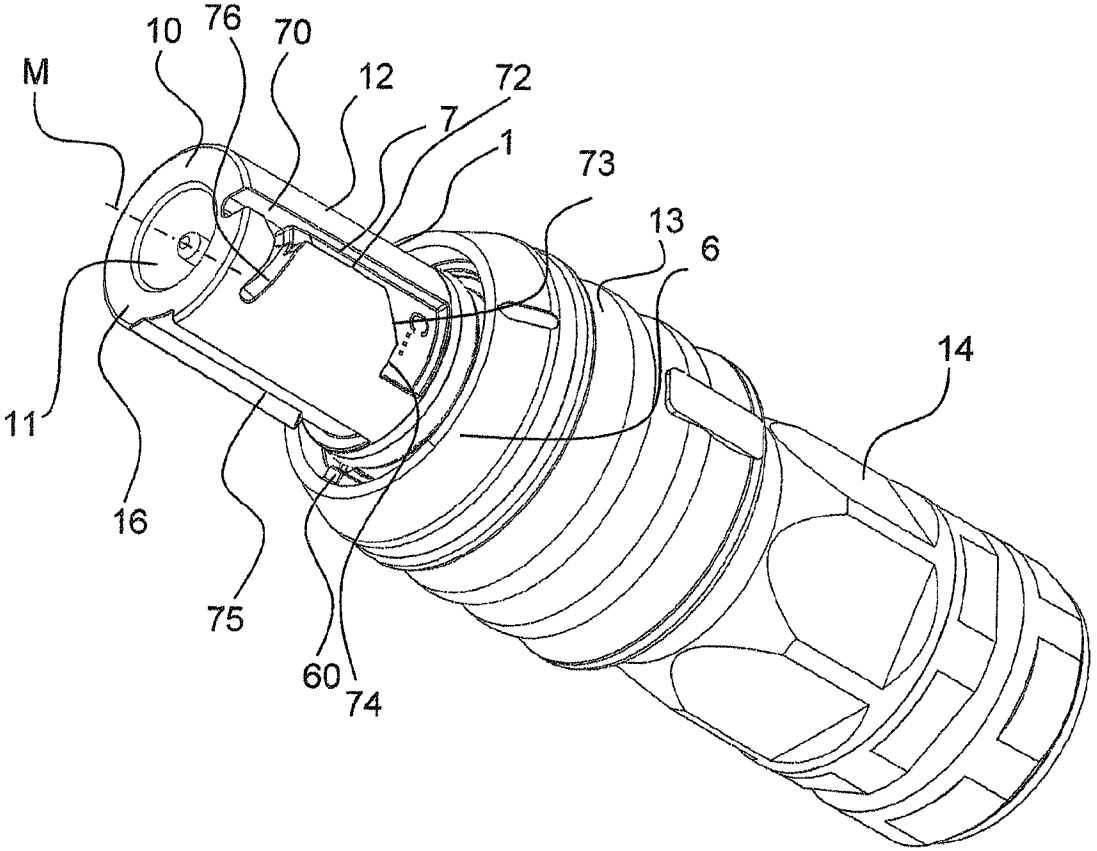
FIG. 1 shows a perspective view of the female-connector side of a plug-type connection.

FIGS. 1 to 8 show parts of a plug-type connection for making an electrical contact between two power cables. The cables typically have a cross-section of between 40 and 600 $m^2$, preferably of 100 to 450 $mm^2$, and are used to transmit electrical energy, wherein the rated voltage is in the order of 1,000 V AC or 1,500 V DC. Another voltage is likewise possible.

The plug-type connection essentially comprises a female-connector side having a housing 1 on the female-connector side and having a female-connector element 3 conducting the electrical current, a male-connector side having a housing 2 on the male-connector side and a male-connector element 4 conducting the electrical current and at least one contact element 5 for making an electrical contact between the female-connector element 3 and the male-connector element 4. If the female-connector side is completely connected to the male-connector side, the plug-type connection is in the connected state, whereupon the electrical contact is then made between the female-connector element 3 and the male-connector element 4. In the connected state the housing 1 on the female-connector side is thus connected to the housing 2 on the male-connector side and the female-connector element 2 is connected to the male-connector element 3.

The connection between the housing 1 on the female-connector side and the housing 2 on the male-connector side is locked via a locking element 6, so that any unwanted disconnection of the plug-type connection is prevented. Consequently, the locking element 6 absorbs force acting in an axial direction.

Figure 2:
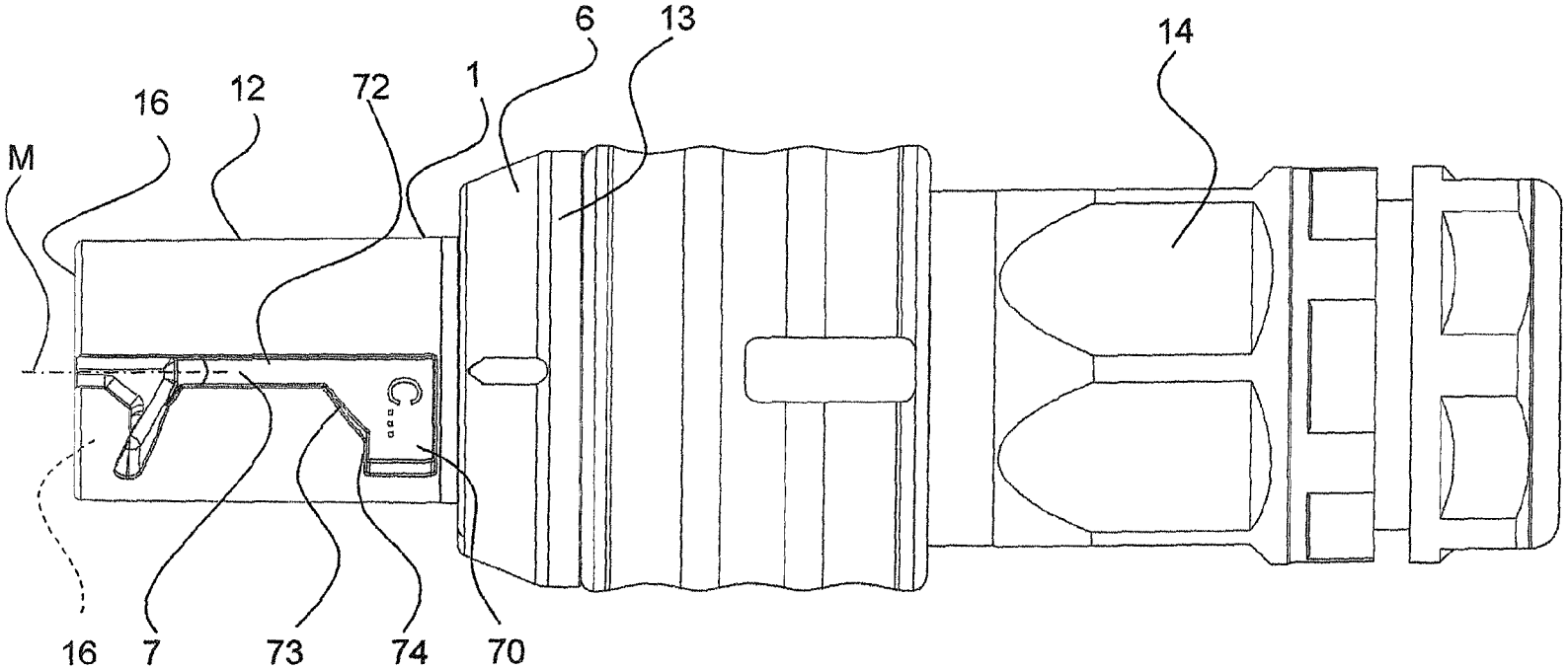
FIG. 2 shows a side view according to FIG. 1.

The housing 1 on the female-connector side is shown In FIGS. 1 and 2. The housing 1 on the female-connector side extends along a mid-axis M and has an essentially hollow-cylindrical form, wherein a side wall 10 delimits an internal space 11. The electrically conductive female-connector element 3 is disposed in the internal space 11, as is explained below with the help of the sectional drawing in FIG. 3.

The housing 1 on the female-connector side comprises a guide section 12, which is used to guide the housing 2 on the male-connector side. The guide section 12 is delimited forwardly by a surface 16. A bearing section 13 is connected to the guide section 12, which is used to support the locking element 6. A cable-receiving section 14 is connected to the bearing section 13, said cable-receiving section being able to form a clamped connection for strain relief with a cable, which is conducted in the internal space 11 through the cable-receiving section 14. The cable conducted in the internal space 11 has an electrically conductive connection to the female-connector element 3, so that an electrically conductive contact is made between the female-connector element 3 and the cable conductor or conductors.

In the area of the guide section 12, the housing 1 on the female-connector side comprises guide elements 7, which are used to guide the housing on the male-connector side during the plug-in process. The guide elements 7 in this case are in the form of a first guide duct 70 and a second guide duct 75, with which a guide comb 71 disposed on the other housing 2 can engage.

As can be clearly seen in FIG. 1, the guide ducts 70, 75 have a first section 72, which extends along the mid-axis M. A second section 73 is attached to the first section 72, said second section being at an angle to the mid-axis M. The angle between the first section 72 and the second section 73 is preferably in the region of 30° to 60°, particularly preferably in the region of 45°. A third section 74 is consequently connected to the second section 73, which is likewise at an angle to the first section 72. The third section 74 is preferably perpendicular to the first section 72.

Figure 3:
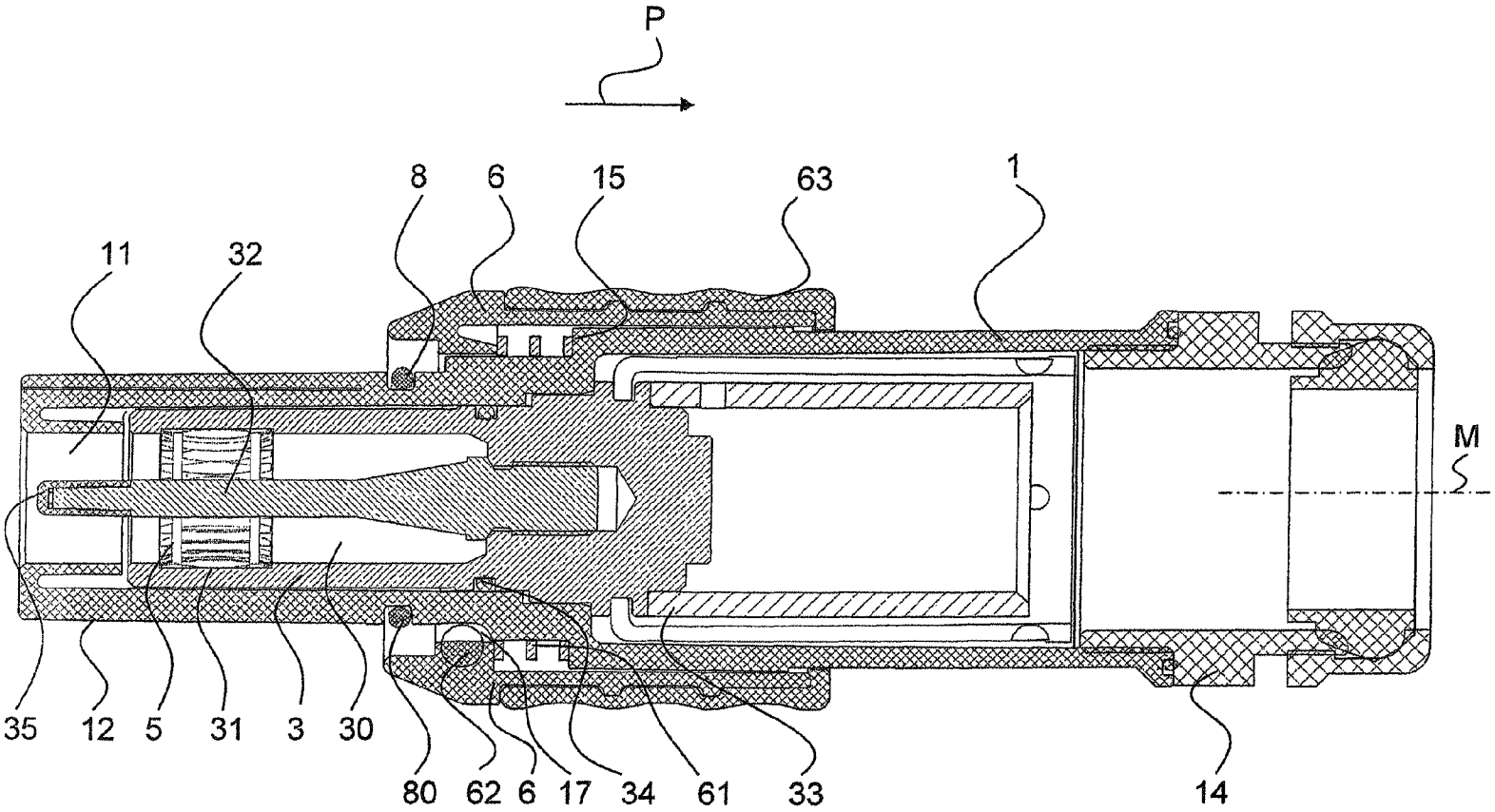
FIG. 3 shows a sectional view according to FIG. 1.

The housing 1 on the female-connector side is shown as a cross-sectional representation in FIG. 3. The female-connector element 3 and the configuration thereof in the internal space 11 of the housing 1 is explained with the help of this representation. The female-connector element comprises a female-connector opening 30, in which the male-connector element 4 comes to rest in the connected state. The female-connector opening 30 has an essentially hollow-cylindrical form with a circular cross-section. A circumferential groove 31 is disposed in the female-connector opening 30, which serves to receive the contact element 5, which exhibits the form of a contact fin in this case. A locating pin 32 is likewise disposed in the female-connector opening 30, said locating pin extending through the entire female-connector opening 30 and, particularly preferably, projecting from the female-connector opening 30. This locating pin 32 is used to guide the male-connector element 4 in the connected state or while the connection is being made. In the front section, the locating pin is surrounded by an insulator cap 35, which is made of a material which does not conduct electrical current, so that the user cannot come into contact with electrically conductive elements.

A contact section 33 is disposed opposite the female-connector opening 30, said contact section coming to rest in the area of the cable-receiving section 14. The contact section 33 is essentially used to receive the electrical conductor of the cable, wherein said cable has an electrically conductive connection via a crimp connection, for example, to the contact section 33 and therefore to the female-connector element 3.

It can also be clearly seen in FIG. 3 that the female-connector element 3 is disposed in the internal space 11 of the housing 1 on the female-connector side. In this case, the female-connector element 3 is disposed such that it cannot be touched by the user from outside. In addition, a sealing element 34 is disposed between the contact element 3 and the housing 1, said sealing element being in the form of an O-ring in this case and sealing the intermediate space between the internal space 11 and the female-connector element 3, so that no moisture from the cable-receiving section 14 is able to reach the area of the contact element 5.

In this case a sealing element 8 is disposed on the outside behind the guide section 12, said sealing element sealing the intermediate space between the housing 1 on the female-connector side and the housing 2 on the male-connector side. The sealing element 8 is in the form of an O-ring in this case, which lies in a groove 80 extending into the housing 1 on the female-connector side.

The locking element 6 is disposed in the area of the bearing section 13, wherein the locking element 6 extends completely around the housing 1 on the female-connector side. The locking element 6 is preferably surrounded by a sleeve 63, via which the user can get a good grip of the locking element 6. The locking element 6 is essentially used to lock the housing 1 on the male-connector side to the housing 2 on the female-connector side in the connected state, wherein the lock particularly prevents the two housings 1, 2 from rotating relative to one another. The housing 1 on the female-connector side comprises an annular locating surface 15 in the area of the bearing section 13, against which a pressure spring 61 rests, which presses the locking element 6 from this locating surface 15 against the guide section 12. The locking element 6 in this case is connected to the housing 1 on the male-connector side such that it is able to perform a limited movement from a locking position into a release position along the mid-axis M. The locking element is always pressed forwards in the direction of the guide section 12 by the pressure spring 61, this corresponding to the locking position. During the plug-in process, the pressure spring is compressed, in other words, the locking element 6 in FIG. 3 is pushed along the arrow P to the right in FIG. 3. As soon as the housing 1 on the female-connector side and the housing 2 on the male-connector side are in the final position, in other words in the connected state, the spring 61 causes the locking element 6 to move back against the direction P into the original position. Due to the arrangement of the springs 61, an automatic locking element can also be referred to.

The locking element 6 further comprises a terminating element 62. The terminating element 62 is rotatably disposed in the locking element 6 and can be rotated through 180° about its own axis. The terminating element 62 is therefore applied to a terminating edge 17 on the housing 1 on the female-connector side. Consequently, the locking element can then no longer be relatively displaced in the direction of the arrow P.

Via a guide not shown in the figures, the locking element 6 is conducted to the housing 1 on the female-connector side, such that no rotation between housing 1 and the locking element 6 is permitted.

Figure 4:
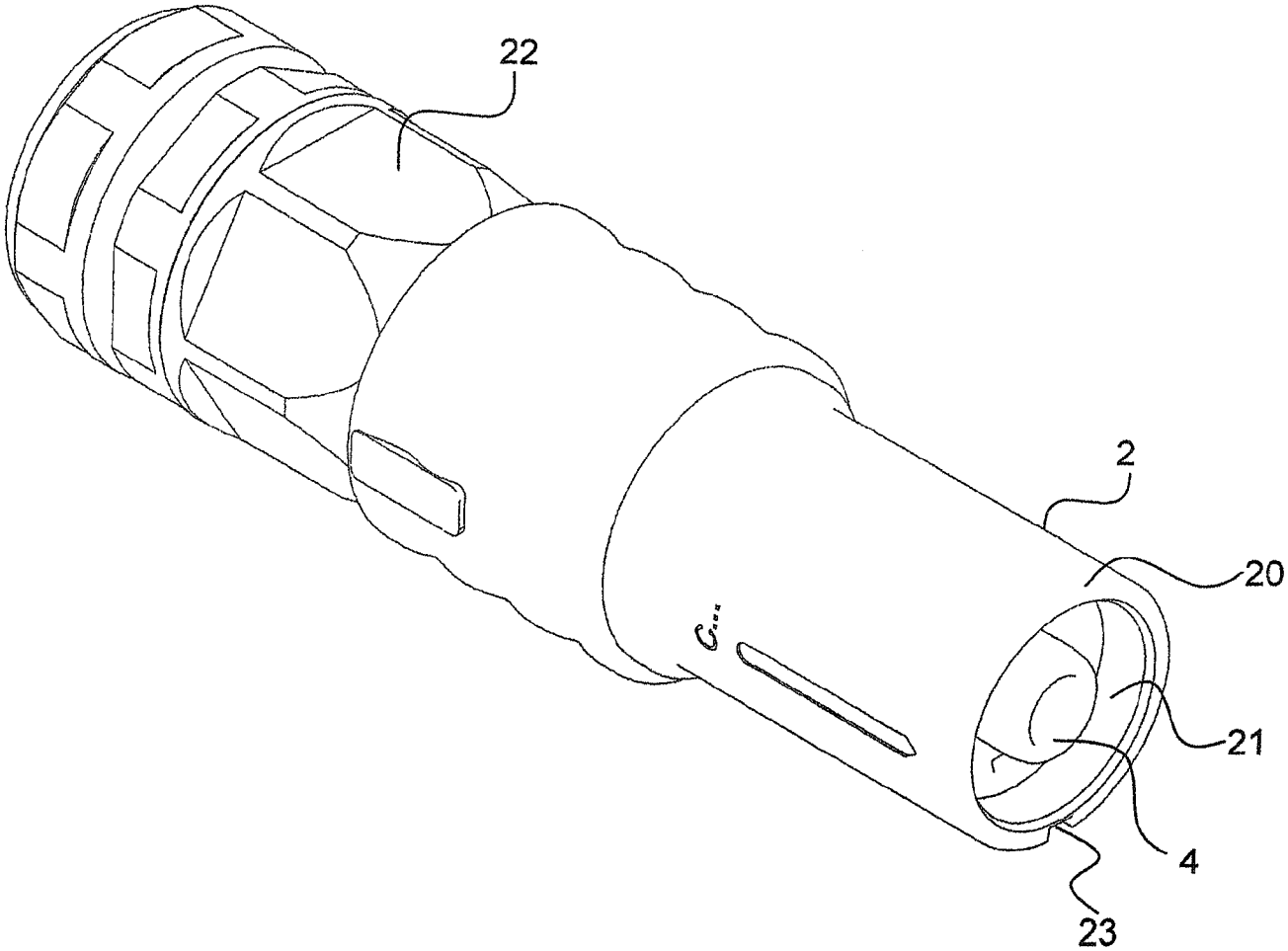
FIG. 4 shows a perspective view of the male-connector side of a plug-type connection.
Figure 5:
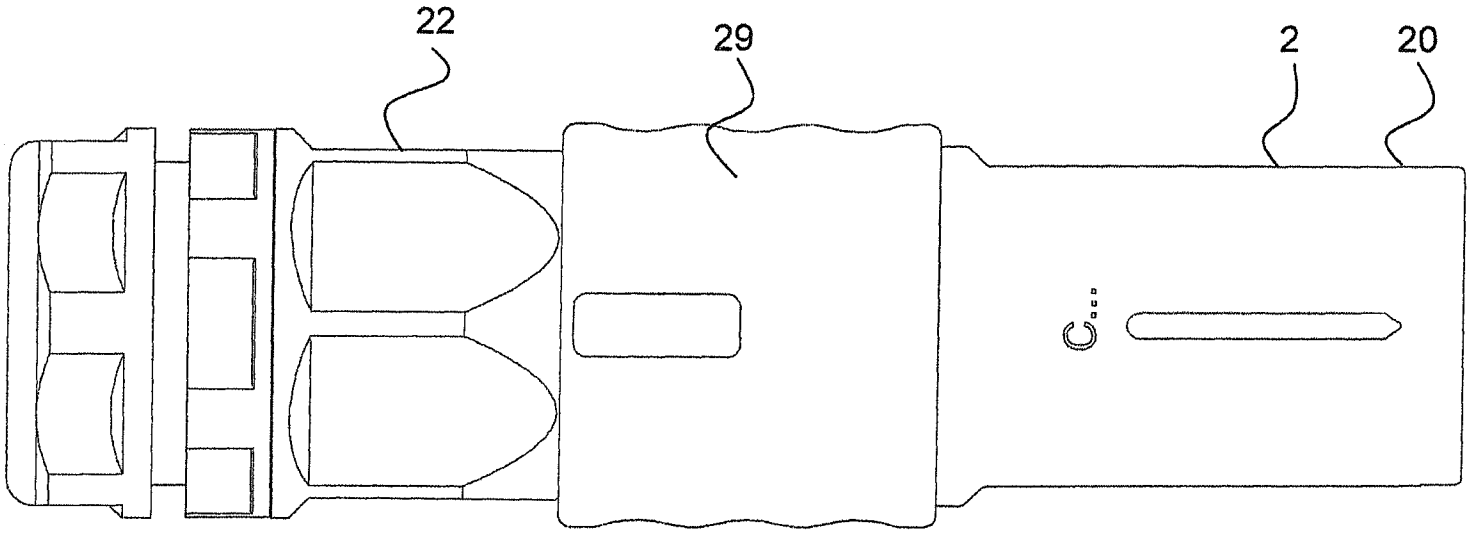
FIG. 5 shows a side view according to FIG. 4.
Figure 6:
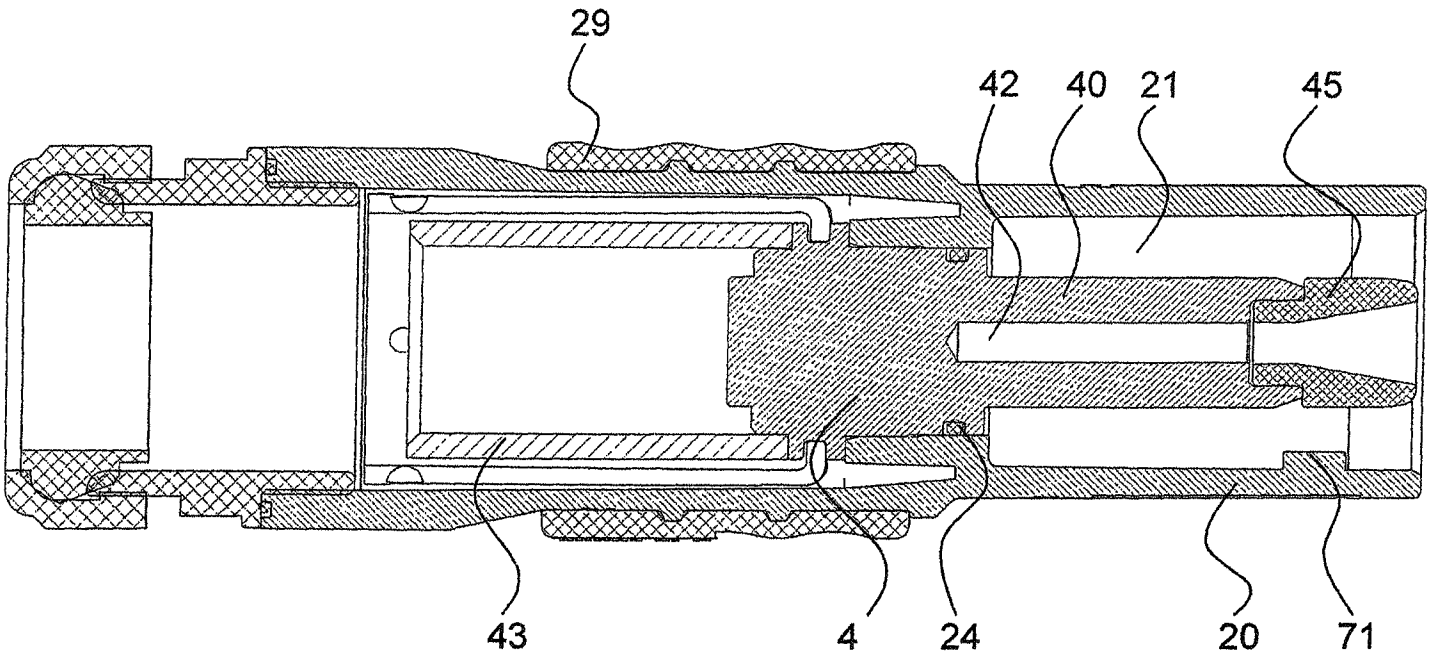
FIG. 6 shows a sectional view according to FIG. 4.

The housing 2 on the male-connector side is shown in FIGS. 4 to 6. The housing 2 on the male-connector side comprises a side wall 20, which delimits an internal space 21. The male-connector element 4 is disposed in the internal space 21. The internal space 21 in this case is formed such that it is able to receive the guide section 12 of the housing 1 on the female-connector side. The male-connector element 4 extends through the internal space 21 and projects in the connected state into the female-connector opening 30. The housing 2 on the male-connector side further comprises a cable-receiving section 22, which is used in a similar manner to the cable-receiving section 14 of the housing 1 on the female-connector side to receive the cable, with which the male-connector element 4 is in electrical contact. The housing 2 on the male-connector side is further surrounded by a sleeve 29, via which the user is able to grip the housing 2.

The male-connector element 4, which can clearly be seen in the FIG. 6, comprises a cylindrical pin section 40, which comes to rest in the female-connector opening 30. At the back, the male-connector section 40 is attached to a contact section 43, which serves to make an electrical contact with the cable. The male-connector section 40 further comprises a central guide opening 42, which is used to receive the locating pin 32 of the female-connector element 3. In the front area, the male-connector section 40 further comprises a protective element 45, which is preferably made of a material that does not conduct electrical current. The male-connector element 4 is completely surrounded by the housing 2 on the male-connector side in the area of the male-connector section 40. Likewise, FIG. 6 shows that a seal 24, in the form of an O-ring in this case, seals the gap between the housing 2 and the contact element 4 against fluids.

It can also be clearly seen in FIG. 6 that a guide comb 71 is disposed in the internal space 21. A guide comb 71 is preferably disposed for each guide duct 70, 75 in this case. The guide comb 71 projects into the corresponding guide duct when the plug-in connection is being made and in the connected state. Via the guide duct 70, 75 pairing, particularly via the third section 74 and the guide comb 71, axial protection can be provided between the two housings 1, 2.

Figure 7:
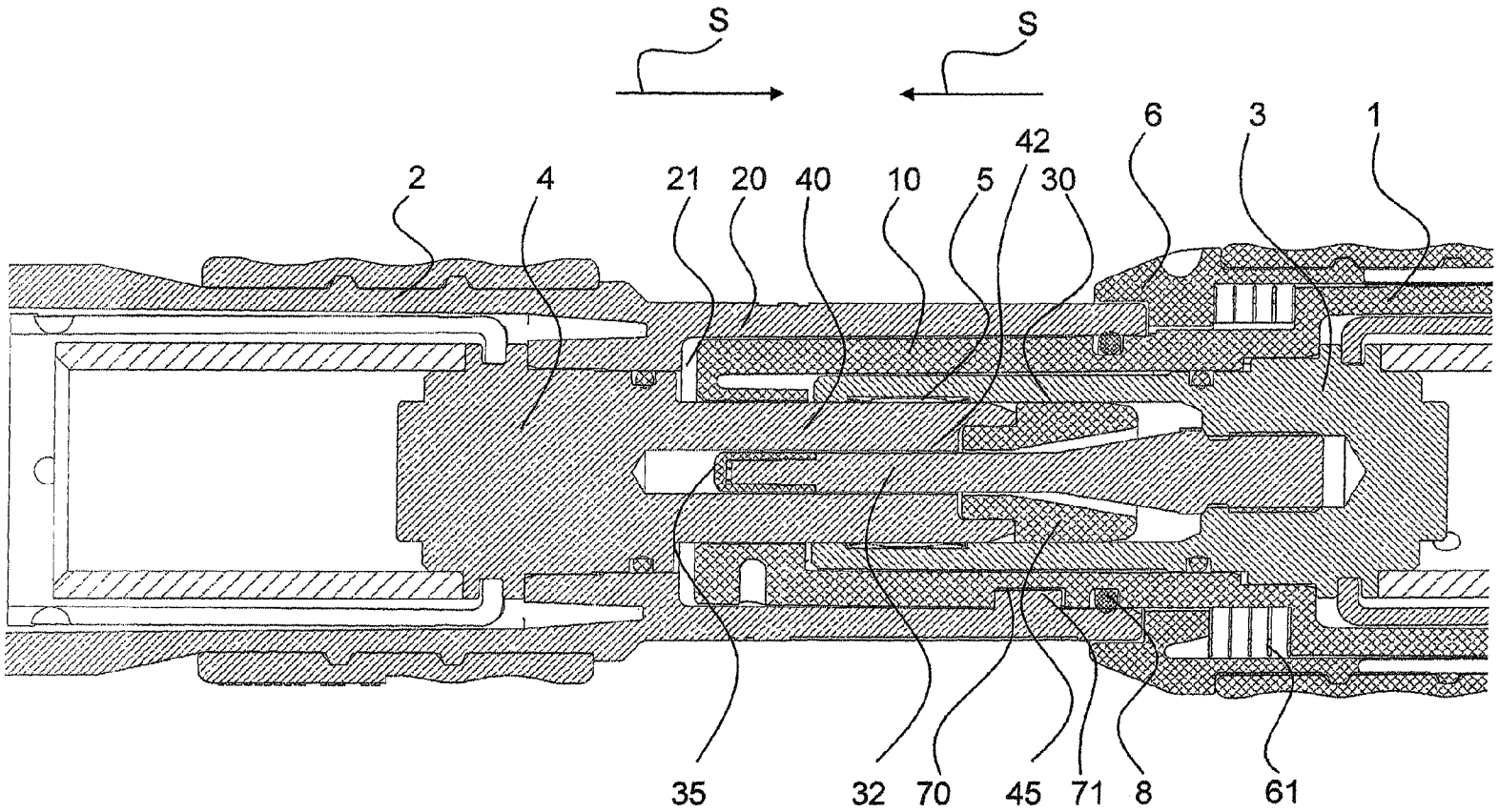
FIG. 7 shows a sectional view of the plug-type connection, wherein the female-connector side according to FIGS. 1 to 3 is connected to the male-connector side according to FIGS. 4 to 6.
Figure 8:
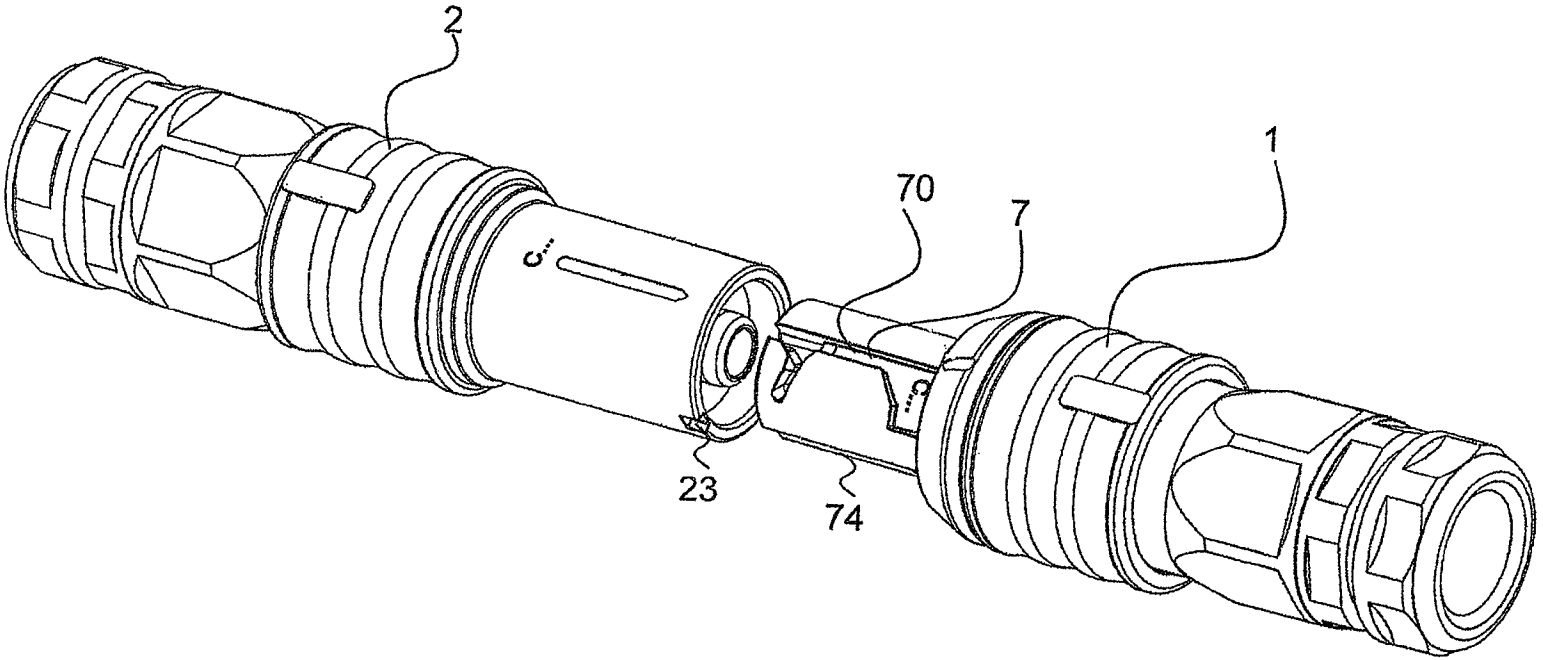
FIG. 8 shows a perspective representation of the male-connector side and the female-connector side just before the connection.

In FIG. 7 the plug-type connection is shown in the connected state, wherein it is easy to see in this case how the female-connector side is connected to the male-connector side. The terms "male-connector side" and "female-connector side" relate to electrically conductive parts, in other words, the female-connector element 3 and the male-connector element 4.

Figure 9:
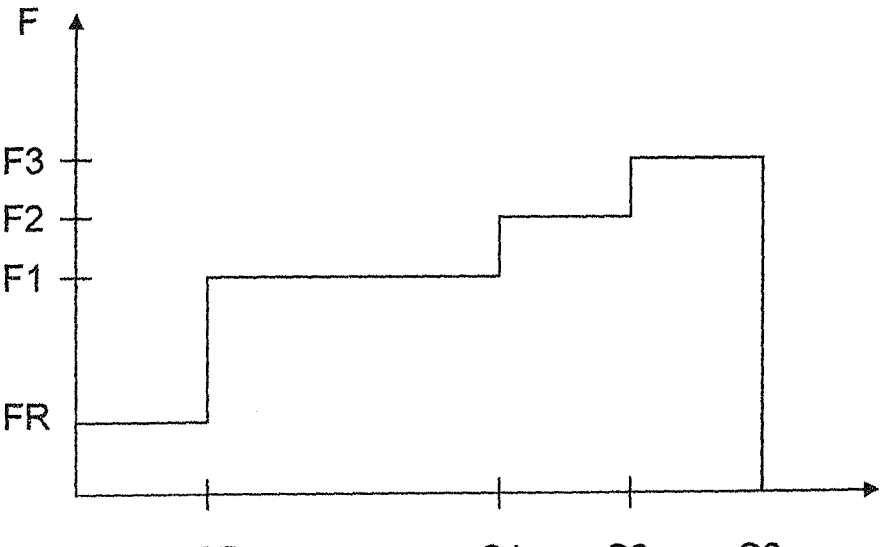
FIG. 9 shows a schematic representation of the force profile during the plug-in process.

A schematic representation of the typical force profile during a plug-in process is shown in FIG. 9. During the plug-in process, the housing 1 on the female-connector side is combined with the housing on the male-connector side, so that an electrically conductive connection exists between the female-connector element 3 and the male-connector element 4.

The plug-in process typically involves a plug-in movement, wherein the housing 1 on the female-connector side and the housing 2 on the male-connector side are displaced towards one another. During the making and breaking of the plug-type connection, these opposing resistive forces in an axial direction must be overcome, so that both housing parts 1, 2 can be moved towards one another. During the plug-in process, various resistive forces must therefore be overcome, in order to bring together the two housing parts 1, 2.

The resistive forces to be overcome are shown in FIG. 9 in relation to the plug-in process. The plug-in path is shown on the x-axis and the corresponding resistive force on the y-axis.

Over a first section up to SR only a very low frictional force FR relative to the other resistive forces has to be overcome between the two housings 1, 2, the female-connector element 2 and the male-connector element 4, as well as the locating pin 32 and the guide opening 25.

As soon as the male-connector element 4 is displaced so far that it is connected to the contact element 5, a first axial resistive force F1 against the plug-in movement is opposed by the contact element 5. The resistive force F1, which must be overcome by the user in order to perform the plug-in movement further, thereby essentially acts over the section SR to S1.

In a next step, the housing is connected either to the sprung locking element 6 and/or the sealing element 8, depending on the configuration, wherein these two likewise produce a resistive force. These two axial resistive forces are represented in FIG. 9 by the second resistive force F2 and the third resistive force F3. The second resistive force F2 is by definition provided by the locking element 6 and the second resistive force F3 by the sealing element 8. It is conceivable in this case for the sealing element 8 to be disposed in front of the locking element 6, seen in the plug-in direction, wherein the third resistive force F3 then has to be overcome before the second. A reverse configuration is also conceivable. It is also possible for the sealing element 8 and the locking element 6 to be disposed at the same height, so that they have to be overcome at the same point in time.

FIG. 9 illustrates that the user has to overcome a large resistive force essentially made up in total of the resistive forces F1, F2 and F3, in order to make the plug connection. With this force the user must bring together the two housings 1, 2.

The processes involved in making the plug-type connection are explained below making reference to FIGS. 1 to 8. The two plug parts are in the initial position in FIG. 8.

In a first stage in making the connection, the housing 1 on the female-connector side and the housing 2 on the male connector side are displaced towards one another along the plug-in movement S in the direction of the mid-axis M. The guide combs 71 engage with the respective guide duct 70, 75 during this. The contact element 5 in the female-contact element 3 further comes into contact with the male-connector element 4 in the female-connector element, wherein the plug-in force must be increased, in order to overcome the first resistive force F2 of the contact element 5.

As soon as the housing 2 on the male connector side is at hand on the limit stop element 60 of the locking element 6, the second resistive force F2 of the locking element 6 opposes the movement. The guide combs 71 are then in the area of the second section 73 of the guide ducts 70, 75. Via a rotational movement of the housing 1 on which the guide combs 71 are disposed to the housing on which the guide ducts 70, 75 are disposed, the guide combs 71 then move along the angular sections 73, wherein the torque is deflected by this angular configuration into an assisting force in the direction of the plug-in direction. For the rotational movement, the user must therefore apply a torque that acts relatively between the two housings 1, 2. The guide elements 7 are formed according to this such that applying a torque to at least one of the two housings 1, 2 results in an assisting force in the direction of the plug-in movement S, so that at least part of the resistive forces F1, F2 and F3 can be overcome by this assisting force. Preferably, however, as shown in the present embodiment, the total resistive forces in the last section of the movement are overcome by the assisting force and consequently by the torque.

The rotational movement has the great advantage that it makes it easier for the user to overcome the axial resistive forces by a rotational movement than by a longitudinal movement. To this extent, the rotational movement is more ergonomic and better corresponds to the movement sequence.

The rotational movement or torque can then be further maintained, so that the guide combs 71 come to rest in the third section 74. In this position the recess 23 in the housing 2 on the male-connector side and the limit stop element 60 stand relative to one another such that the limit stop element 60 comes to rest in the recess 23. Due to the configuration of the springs 61, the locking element 6 is therefore pushed in the direction of the housing 2 on the male-connector side, so that the limit stop element 60 locks into the catching recess 23 on the side wall 20. This locking connection prevents the housing 1 on the female-connector side from rotating to the housing 2 on the male-connector side. Because rotation is prevented, it is also ensured that the guide combs 71 remain in the guide track sections 74 running perpendicular to the mid-axis M, wherein it is thereby ensured that the two housings 1, 2 are not pulled apart from one another in the direction of the mid-axis M.

If the plug-type connection is now to be broken again, the locking element 6 must be moved backwards against the spring force of the springs 61, in other words away from the housing 2 on the male-connector side, so that the two housings 1, 2 can be rotated relative to one another. As soon as the catching engagement between the limit stop element 60 and the catching recess 23 is released, the restoring force of the springs 61 acts on the locking element 6, which for its part acts via the limit stop 60 on the housing 2 on the male-connector side, which helps release the connection. The guide combs 71 are pressed against the second section 72 due to the spring force. When breaking the connection, the first resistive force F1 of the contact element 5 and the third resistive force F3 of the sealing element 8 must therefore be overcome, whereupon the spring force of the pressure springs 60 has an assisting action. In addition, an assisting force is in turn provided, as described above, via the rotational movement between the two housings 1, 2, whereupon this assisting force supports the breaking action in this case.

The terminating element may be optionally operated following the successful making of the plug-in connection, so that the plug-type connection is protected from accidental separation. For this purpose, the terminating element 62 is preferably rotated through 180°. If the user wishes to break the plug-type connection, the terminating element 62 is turned back again through 180°, in order to release the lock.

It should be mentioned at this point that the guide ducts 70, 75 can also be disposed on the housing 2 on the male-connector side and the guide combs 71 on the housing 1 on the male-connector side, wherein the same effect is thereby achieved.

In the area of the first section 72 the guide duct 70 may still include a lateral recess 76, which can be used as the operating element, for example, in some applications.

The housing 1 on the female-connector side and also the housing 2 on the male-connector side are preferably made entirely of a material that does not conduct electrical current, such as a plastic. Particularly preferred is a material from the polyamide group.

REFERENCE NUMBER LIST

1 Housing on the female-connector side
2 Housing on the male-connector side
3 Female-connector element
4 Male-connector element
5 Contact element
6 Locking element
7 Guide elements
8 Sealing element
10 Side wall
11 Internal space
12 Guide section
13 Bearing section
14 Cable-receiving section
15 Locating surface
16 Surface
17 Terminal edge
20 Side wall
21 Internal space
22 Cable-receiving section
23 Catching recess
24 Seal
29 Sleeve
30 Female-connector opening
31 Groove
32 Locating pin
33 Contact section
34 Sealing element
35 Insulation cap
40 Pin section
42 Guide opening
43 Contact section
45 Protective element
60 Limit stop
61 Spring
62 Terminating element
63 Sleeve
70 First guide duct
71 Guide comb
72 First section
73 Second section
74 Third section
75 Second guide duct
76 Recess
80 Groove
M Mid-axis
S Plug-in movement
F1 First resistive force (contact element)
F2 Second resistive force (locking element)
F3 Third resistive force (sealing element)

The invention claimed is:

1. A plug-type connection comprising a housing on the female-connector side having at least one female-connector element conducting the electrical current, a housing on the male-connector side having at least one male-connector element conducting the electrical current and at least one contact element for making an electrical contact between the female-connector element and the male-connector element, wherein the female-connector element and the male-connector element extend substantially along a mid-axis and wherein the housing on the female-connector side and the housing on the male-connector side and therefore the female-connector element and the male-connector element can be connected to one another via a plug-in movement and an electrical contact between the female-connector and the male-connector element is produced in the connected state wherein the contact element produces a first resistive force counter to the plug-in movement, wherein the plug-type connection furthermore comprises an automatically self-locking locking element for locking the plug-type connection, said locking element producing a second resistive force counter to the plug-in movement, and wherein guide elements are provided between the housing on the female-connector side and the housing on the male-connector side, said guide elements being designed such that the application of a torque to at least one of the two housings results in an assisting force in the direction of the plug-in movement, with the result that at least part of the resistive forces can be overcome by said assisting force, wherein the guide elements comprise a guide duct and at least one guide comb projecting into the guide duct, wherein the guide duct runs via a first section parallel to the plug-type connection and via a second section at an angle in the region of 30° to 60° to the plug-in movement, wherein with the interaction between said comb and said second section said torque results in said assisting force.

2. The plug-type connection according to claim 1, wherein a sealing element is furthermore disposed between the housing on the female-connector side and the housing on the male-connector side, which seals the gap between the housing on the female-connector side and the housing on the male-connector side against fluids, such as water, or air, wherein the sealing element produces a third resistive force counter to the plug-in movement.

3. The plug-type connection according to claim 1, wherein the guide elements are preferably designed such that the plug-in movement runs over a first section along a translational motion parallel to the mid-axis and over a second section with a rotational motion or a combination of rotational and translational motion.

4. The plug-type connection according to claim 1, wherein the locking element has a limit stop, which the one housing strikes during the plug-in movement, wherein the locking element is displaced in a translatory manner with the one housing via this limit stop and wherein the second resistive force opposes the plug-in movement when the locking element is displaced via the housing.

5. The plug-type connection according to claim 1, wherein when the connected state is reached, the locking element is automatically moved against the plug-in direction from the housing against which the locking element lies to the other housing, and a lock preventing rotation of the housings relative to one another is thereby provided, wherein the lock is supplied particularly by the limit stop, which projects into a catching recess on the other housing.

6. The plug-type connection according to claim 1, wherein the locking element is disposed such that the assisting force takes effect when the second resistive force also has to be overcome.

7. The plug-type connection according to claim 1, wherein the sealing element is disposed such that the assisting force takes effect when the third resistive force also has to be overcome.

8. The plug-type connection according to claim 1, wherein the locking element is disposed such that the assisting force takes effect when the second resistive force also has to be overcome and wherein the sealing element is disposed such that the assisting force takes effect when the third resistive force also has to be overcome.

9. The plug-type connection according to claim 1, wherein the locking element is connected either to the housing on the female-connector side or to the housing on the male-connector side and that a spring applies the second resistive force.

10. The plug-type connection according to claim 1, wherein the locking element is in the form of a casing, wherein the locking element is connected either to the housing on the female-connector side or to the housing on the male-connector side and essentially completely surrounds the respective housing.

11. The plug-type connection according to claim 1, wherein the locking element is secured to prevent rotation relative to the corresponding housing.

12. The plug-type connection according to claim 1, wherein a terminating element is disposed, with which the locking element can be locked to prevent unwanted rotation.

* * * * *